US008104879B2

(12) United States Patent
Barbet

(10) Patent No.: US 8,104,879 B2
(45) Date of Patent: Jan. 31, 2012

(54) PRINTING BY DIFFERENTIAL INK JET DEFLECTION

(75) Inventor: Bruno Barbet, Etoile sur Rhone (FR)

(73) Assignee: IMAJE S.A., Bourg les Valence (FR)

( * ) Notice: Subject to any disclaimer, the term of this patent is extended or adjusted under 35 U.S.C. 154(b) by 879 days.

(21) Appl. No.: 12/083,388

(22) PCT Filed: Oct. 11, 2006

(86) PCT No.: PCT/EP2006/067268

§ 371 (c)(1),
(2), (4) Date: Apr. 9, 2008

(87) PCT Pub. No.: WO2007/042530

PCT Pub. Date: Apr. 19, 2007

(65) Prior Publication Data

US 2009/0231398 A1 Sep. 17, 2009

Related U.S. Application Data

(60) Provisional application No. 60/750,483, filed on Dec. 14, 2005.

(30) Foreign Application Priority Data

Oct. 13, 2005 (FR) ..... 05 53117

(51) Int. Cl.
*B41J 2/09* (2006.01)

(52) U.S. Cl. ..... 347/77

(58) Field of Classification Search ..... 347/73–76, 347/78–82, 90; 37/77
See application file for complete search history.

(56) References Cited

U.S. PATENT DOCUMENTS

| | | | |
|---|---|---|---|
| 3,373,437 | A | 3/1968 | Sweet et al. |
| 3,596,275 | A | 7/1971 | Sweet |
| 4,346,387 | A | 8/1982 | Hertz |
| 4,350,986 | A | 9/1982 | Yamada |
| 4,547,785 | A | 10/1985 | Jones |
| 5,070,341 | A | 12/1991 | Wills et al. |
| 6,273,559 | B1 | 8/2001 | Vago et al. |
| 7,273,270 | B2 | 9/2007 | Katerberg |
| 7,364,276 | B2 | 4/2008 | Piatt et al. |
| 7,712,879 | B2 | 5/2010 | Barbet |
| 2003/0156169 | A1 | 8/2003 | Martin et al. |
| 2003/0222950 | A1 | 12/2003 | Jeanmaire |
| 2010/0045753 | A1 | 2/2010 | Barbet |

FOREIGN PATENT DOCUMENTS

| | | |
|---|---|---|
| EP | 0013504 | 7/1980 |

(Continued)

OTHER PUBLICATIONS

International Preliminary Report, PCT/EP2006/066248, dated Nov. 19, 2007.

(Continued)

*Primary Examiner* — Kristal Feggins
(74) *Attorney, Agent, or Firm* — Nixon Peabody LLP

(57) ABSTRACT

For printing, the principle of the continuous deflected jet is used: a device (1) discharges a continuous stream (2) of a conductive liquid, which is deflected by an electric field created by a deflecting electrode (8) and directed toward a gutter (6). The printing of drops (12) is performed by fragmenting the continuous jet (2) into a segment (10) formed opposite a shield electrode (14) upstream of the deflecting electrode (8), so that the segment (10) is not deflected and can be directed toward a substrate (16).

21 Claims, 2 Drawing Sheets

FOREIGN PATENT DOCUMENTS

| | | | |
|---|---|---|---|
| EP | 0911161 | A2 | 4/1999 |
| EP | 0911165 | A2 | 4/1999 |
| EP | 0911166 | A2 | 4/1999 |
| EP | 0911167 | A2 | 4/1999 |
| EP | 0949077 | A1 | 10/1999 |
| EP | 1092542 | A1 | 4/2001 |
| EP | 1219429 | A2 | 7/2002 |
| GB | 1521889 | | 8/1978 |
| GB | 1528269 | | 10/1978 |
| JP | 59014970 | | 1/1984 |
| JP | 60004065 | | 1/1985 |
| WO | 88/01572 | | 3/1988 |

OTHER PUBLICATIONS

Notice of Allowance in U.S. Appl. No. 11/991,508, mailed Dec. 29, 2009.

Notice of Allowance in U.S. Appl. No. 12/443,407, mailed Nov. 1, 2011.

Office Action in U.S. Appl. No. 12/443,407, mailed Mar. 18, 2011.

International Search Report and Written Opinion in International Application No. PCT/EP2006/066248, dated Jan. 16, 2007.

International Search Report and Written Opinion in International Application No. PCT/EP2007/060538, dated Jan. 10, 2008.

International Search Report and Written Opinion in International Application No. PCT/EP2006/067268, dated Feb. 13, 2007.

International Preliminary Report on Patentability in International Application No. PCT/EP2006/067268, dated Jan. 7, 2008.

International Preliminary Report on Patentability in International Application No. PCT/EP2007/060538, dated Dec. 12, 2008.

French Search Report in French Application No. FR 0553117, dated Aug. 30, 2006.

French Search Report in French Application No. FR 0654112, dated May 7, 2007.

PRINTING BY DIFFERENTIAL INK JET DEFLECTION

CROSS REFERENCE TO RELATED APPLICATIONS OR PRIORITY CLAIM

This application is a national phase of International Application No. PCT/EP2006/067268 entitled "PRINTING BY DIFFERENTIAL INK JET DEFLECTION", which was filed on Oct. 11, 2006, and which claims priority of French Patent Application No. 05 53117, filed Oct. 13, 2005 and United States Provisional Patent Application No. 60/750,483, filed Dec. 14, 2005.

TECHNICAL FIELD

The invention is in the field of liquid projection that is inherently different from atomisation techniques, and more particularly of controlled production of calibrated droplets, for example used for digital printing.

The invention relates particularly to selective deviation of droplets relative to a flow for which one preferred but not exclusive application field is ink jet printing; the relative deflection of the droplet is achieved through a deflection of the ink flow so that the segments of the liquid jet generating the droplets are not, or less, deflected. The device and method according to the invention relate to any asynchronous liquid segment production system in the continuous jet field, as opposed to drop-on-demand techniques.

BACKGROUND ART

Typical operation of a continuous jet printer may be described as follows: electrically conductive ink is kept under pressure in an ink reservoir which is part of a print head comprising a body. The ink reservoir comprises particularly a chamber that will contain ink to be stimulated, and housing for a periodic ink stimulation device. Working from the inside outwards, the stimulation chamber comprises at least one ink passage to a calibrated nozzle drilled in a nozzle plate: pressurised ink flows through the nozzle, thus forming an ink jet which may break up when stimulated; this forced fragmentation of the ink jet is usually induced at a point called the drop break up point by the periodic vibrations of the stimulation device located in the ink contained in the ink reservoir.

Such continuous jet printers may comprise several print nozzles operating simultaneously and in parallel, in order to increase the print surface area and therefore the print speed.

Starting from the break up point, the continuous jet is transformed into a sequence of calibrated ink drops. A variety of means is then used to select drops that will be directed towards a substrate to be printed or towards a recuperation device commonly called a gutter. Therefore the same continuous jet is used for printing or for not printing the substrate in order to make the required printed patterns.

The selection conventionally used is the electrostatic deflection of drops from the continuous jet: a first group of electrodes close to the break up point called charging electrodes selectively transfers a predetermined electrical charge to each drop. All drops in the jet, some of which having been charged, then pass through a second arrangement of electrodes called the deflection electrodes generating an electrical field that will modify the trajectory of the drops depending on their charge.

This electrostatic deflection of calibrated liquid drops issued from fragmentation of a continuous jet is a solution widely used in ink jet printing. For example, the deviated continuous jet variant described in document U.S. Pat. No. 3,596,275 (Sweet) consists of providing a multitude of voltages to charge drops with a predetermined charge, at an application instant synchronised with the generation of drops so as to accurately control a multitude of drop trajectories. The positioning of droplets on only two preferred trajectories associated with two charge levels results in a binary continuous jet print technology described in document U.S. Pat. No. 3,373,437 (Sweet).

For all these devices, the charging signal is determined according to the trajectory to be followed by the drop, and other factors. The main disadvantages of this concept for use with multiple jets are firstly the need to place different electrodes close to each jet, and secondly to control each electrode individually.

Another approach consists of setting the charging potential and varying the stimulation signal to move the jet break up location: the quantity of charge carried by each drop and consequently the drop trajectory will be different, depending on whether the drop is formed close to or far from a charging electrode common to the entire array of jets. The set of charging electrodes may be more or less complex: a multitude of configurations is explored in document U.S. Pat. No. 4,346,387 (Hertz). The major advantage of this approach is the mechanical simplicity of the electrode block, but transitions between two deflection levels cannot be easily managed: the transition from one break up point to another produces a series of drops with uncontrolled intermediate trajectories.

Solutions have been considered to overcome this difficulty comprising a modulation of the break length in EP 0 949 077 (Imaje), but with a tight tolerance on the break up length (typically a few tens of microns) that is difficult to control; or management of partially charged portions of the jet with a length equivalent to the distance separating two clearly defined break up locations in EP 1 092 542 (Imaje), but this requires management of two break up points and the useful drop generation frequency has to be reduced, with the production of unusable jet segments.

An alternative to the selective deflection of calibrated drops involves the direct deflection of the continuous jet, for example, by means of a static or variable electrostatic field. For example, in document GB 1 521 889 (Thomson), this technology is used to produce marks, with substantial deflection of a jet by causing the amplitude of the electrostatic field to vary, so that the jet enters or leaves a gutter according to printing requirements. However, the management of transitions is problematic: the jet hits the edge of the gutter and pollutes it. An alternative, described in U.S. Pat. No. 5,070,341 (Wills) consists of deflecting and amplifying the deflection of the jet by means of a set of electrodes to which phase-shifted potentials are applied, wherein the phase-shifting is dependent on the forward speed of the jet: the end of the continuous jet produces drops which are either collected by a gutter, or projected onto a print medium.

In general, even for recent developments such as those of the Kodak company for its drop generator based on a heat stimulation technique allowing for unusual drop production regimens, all of the solutions proposed for jet deflection (heat EP 0 911 166, electrostatic EP 0 911 167, hydrodynamic EP 0 911 165, Coanda effect EP 0 911 161, and so on), without exception, present the problem of transitions between deflected and undeflected portions of the jets.

SUMMARY OF THE INVENTION

One of the advantages of the invention is to overcome the disadvantages of existing print heads; the invention relates to the management of deflection of liquid jet segments.

More generally, the invention relates to a printing technique based on the production and printing of segments of liquid from a continuous conductive jet. The path of the continuous jet is separated from that of the printable segments by means of a set of electrodes located downstream of the jet formation and stimulation means. According to the invention, the continuous jet itself is deflected, not only the drops used for printing. The method and the device associated with this technique are more specifically suitable for multijet printing, as the level of deflection is advantageously binary.

According to one of its embodiments, the invention relates to a method for differentially and selectively deflecting portions of an ink jet including the formation of a continuous jet of predetermined speed and according to a hydraulic path leaving a nozzle of a pressurised chamber of liquid which may or not be electrically conductive, in particular ink. The jet is disturbed so as to break up at a jet break up point and produce segments having a fixed, but preferably adjustable, length; the perturbation can in particular be caused by a piezoelectric device placed at the level of the liquid chamber. In particular, the perturbation is caused by a pair of pulses, preferably identical, on the stimulation device, wherein the time interval separating the two pulses makes it possible to provide the length of the jet segment separated from the rest of the jet. The break up point is at an almost constant distance from the nozzle, irrespective of the size of the segment which is produced.

Downstream of the break point, the jet is exposed to an electric field, generated, for example, by placing an electrode under high potential, so that it is deflected from the hydraulic path. The deflection is different for the continuous jet and the short segments formed upstream the electrode. Advantageously, to increase the deflection difference, a shield is generated at the level of the break up point, for example by an electrode brought to the same potential as the flowing liquid, upstream of the deflecting electrode, with the shield extending longitudinally along the hydraulic path along a length preferably greater than or equal to the length of the segments; thus, the segments are not deflected by the electric field and remain in the hydraulic path, while the rest of the jet is deflected. Preferably, the distance separating two consecutive segments, i.e. the duration separating two pairs of successive pulses, is such that the residual jet portion is exposed to the electric field in its entirety and is therefore maximally deflected. Once this deflection of the residual jet portion has been achieved, it is possible, preferably downstream of the deflecting electrode, to fragment the residual jet portion so as to form drops.

According to the invention, for an application in printing, the segments form spherical drops, owing to the surface tension, which are directed toward a substrate to be printed, and the residual jet portions, like the continuous jet, are directed toward an ink collection gutter.

It is particularly advantageous to apply this method to multijets, i.e. to form a plurality of jets by means of a plurality of parallel nozzles, and to disrupt them individually. The shield and deflection can be carried out by means common to the plurality of jets.

In another embodiment, the invention relates to a device particularly suitable for this method. In particular, the device includes a pressurised chamber of liquid including a nozzle through which it can be discharged; preferably, a plurality of chambers and nozzles are provided, and the device forms a portion of an ink jet print head. Means for disturbing the flowing jet are provided at the level of each chamber, advantageously in the form of a piezoelectric actuator coupled to stimulation means in the form of low-voltage electrical pulses.

The device according to the invention also includes shield means, for example, an electrode being preferably single for the plurality of nozzles, brought to the same potential as the ink being discharged from the chamber, the thickness of which extending over a certain length downstream of the jet outlet. In addition, deflection means, advantageously in the form of an electrode brought to a high potential, being also preferably single for the plurality of nozzles, are located downstream of the shield means so as to generate an electric field deflecting every portion of the jet going beyond the shield means. According to their length, the segments formed by the disruptions of the jet are thus selectively deflected, with the small segments being directed toward a substrate to be printed, and the residual portions of the continuous jet being directed toward a collection gutter.

BRIEF DESCRIPTION OF THE DRAWINGS

Other characteristics and advantages of the invention will become clearer after reading the following description with reference to the attached drawings, given as illustrations and that are in no way limitative.

The FIG. 1 show the deflection principle according to the invention, with FIG. 1A showing the non-printing situation, and FIG. 1B showing a stimulation signal generating drops as diagrammed in FIG. 1C.

DETAILED PRESENTATION OF PARTICULAR EMBODIMENTS

According to the invention, the continuous jet formed by the print head itself is deflected, and its main portion is not intended to be printed; for printing, segments of variable length are taken from the ink jet asynchronously, and directed toward the substrate. These portions are separated from the jet before facing a high voltage electrode so that portions are not electrically charged and their eventual deflection is different from the main jet, the system generally operates in binary mode.

Figure 1A:
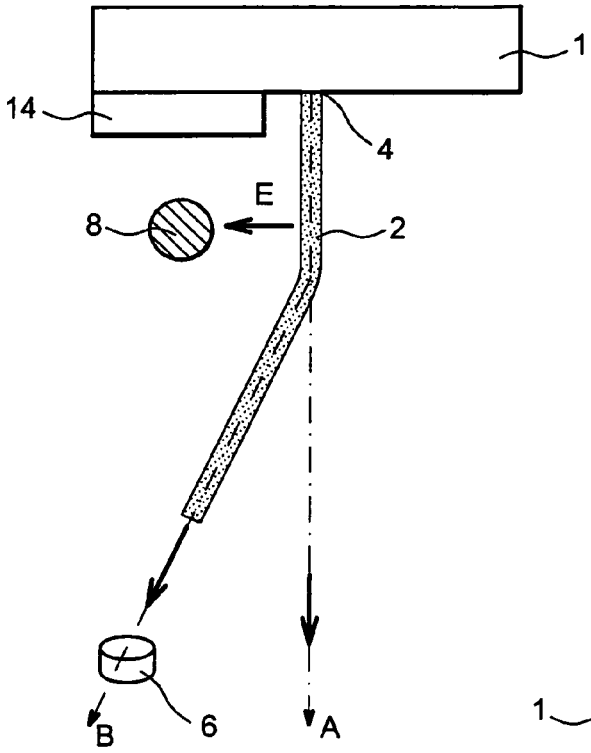

In particular, as shown in FIG. 1A, in the non-printing situation, a drop generator 1, which is, for example, activated by a piezoelectric device, forms a continuous liquid jet 2. The jet 2 discharged by the nozzle 4 of the generator 1 at a predetermined speed V is deflected from the axis A of the nozzle 4 by means of an electric field E, so as to be directed toward an ink collection gutter 6, along a deflected path B. Preferably, the electric field E is created by an electrode 8 brought to a high potential, which forms a capacitor with the jet 2. The attractive force between the two jet/electrode capacitor plates 2, 8 is primarily dependent on the difference in potential and the distance between the jet 2 and the electrode 8; in particular, the attractive force between the two capacitor plates 2, 8 is proportional to the square of the voltage HT.

According to the speed of the jet V, it is thus possible to determine the angle formed between the deflected path B and the hydraulic path A, as well as the length of the print head or the distance between the nozzle 4 and the gutter 6. Typically, the jet with a radius of 35 μm is discharged at V=10 m/s, the electrode 8 is brought to 1000 V and is located at a distance of around 400 μm from the axis A of the nozzle 4, i.e. around 8 to 15 times the radius of the continuous jet 2 being discharged from the nozzle 4; a different set of parameters that maintain the same ratios will enable a different working point to be obtained.

The printing of an ink drop on a substrate requires the jet to be broken twice so as to delimit a segment of liquid which will form, by way of surface tension, said drop.

Figure 1B:
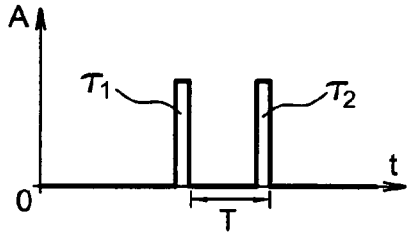
Figure 1C:
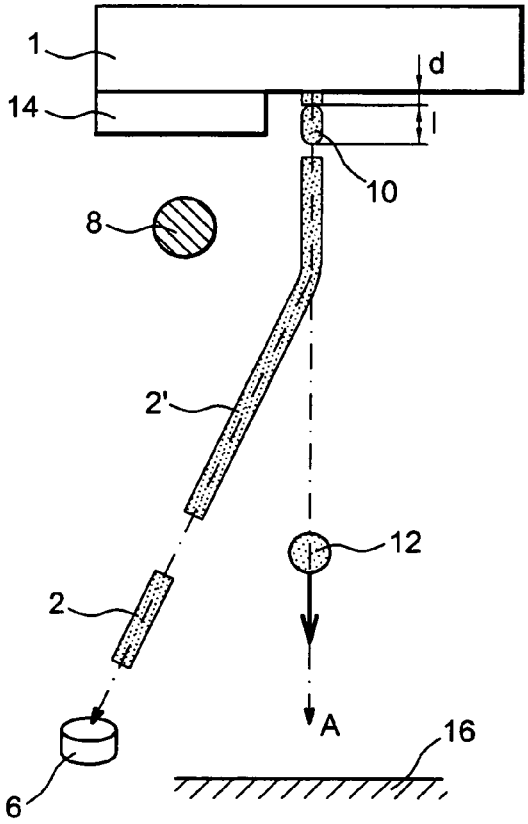

As shown in FIG. 1B, the stimulation signal thus comprises a first pulse $\tau_1$ which causes the jet 2 to be broken up at a known and controlled distance d from the nozzle plate 4; for a piezoelectric generator, this pulse $\tau_1$ includes a short command to apply a predetermined voltage, for example 30 V, for a duration of approximately 2 μs. A second pulse $\tau_2$, preferably of the same type (duration and amplitude) as the first $\tau_1$, causes a second break up in the jet 2, at the same distance d from the nozzle plate 4. During the time interval T which separates the two pulses $\tau_1$, $\tau_2$, as shown in FIG. 1C, the jet 2 advanced by a distance of 1=V·T, which corresponds to the length of a segment 10 separated from the jet 2, and which is directly related to the diameter of the drop 12 formed. The residual jet 2 is also fragmented into two parts 2, 2', which are both directed toward the gutter 6, by the influence of the field E.

Preferably, the polarity of the pulse τ is such that its action produces a local thinning of the jet 2, leading to its breakage. The duration of the pulse is selected so that the stimulated (thinned) portion of the jet 2 is smaller than the diameter of the jet 2, typically of the order of the radius of the jet: $V \cdot \tau \approx R$.

The segment 10 is short and unaffected by the field E. Preferably, it is not subjected to the deflection by the electrode 8; therefore, the break up point of the jet 2 is located at the level of a shield 14 which shields the break up point from the electric field E produced by the deflecting electrode 8. The shield can consist of one electrode 14, in the form of a plate, advantageously brought to the same potential as the liquid and the nozzle 4, so that the electric charge q borne by the short segment 10 is zero, or very low. Consequently, the jet segment 10 is not, or is very slightly, deflected when it passes in front of the deflecting electrode 8, and its path is close to the hydraulic path A of the jet 2 being discharged from the nozzle 4. The formed segment 10 and the resulting drop 12, therefore, are not intercepted by the ink collection gutter 6, but can be directed to a substrate 16 to be printed.

The length 1 of the segment 10 can easily be adjusted, by modifying the duration T of the time interval which separates the two stimulation pulses $\tau_1$, $\tau_2$, in particular between 2 and 40 μs, thereby making it possible to produce, as desired, impacts of variable size on the substrate 16. The break up point as such is not displaced and remains at the almost constant distance d from the nozzle 4.

The length 1 of the segment 10 is preferably less than or equal to the distance that separates the break up site from the downstream end of the shield electrode 14, so as to ensure the electrical neutrality of the segment 10 and therefore to promote the differential deflection between the continuous jet 2 and the printable drops 12. Compliance with this criterion is not, however, limiting.

The high potential HT of the deflecting electrode 8 is preferably static, and can be either positive or negative. However, a variable or alternative potential (shown in FIG. 2) is suitable for deflecting the jet, as the mean value of the electrostatic pressure P induced is proportional to the square of the high voltage ($P \propto HT^2$). In this case, in order to minimise the amplitude of the wave of the jet around the mean deflection level, a jet section 2 transiting in front of the electrode 8 is preferably exposed to a plurality of high-potential periods; typically, the oscillation frequency must be higher than the ratio of the forward speed V of the jet 2 over the electrode 8 length. In addition, the average potential is preferably zero, with, for example, a sinusoidal high voltage: the advantage of such a variable potential is to create a field E with an average value of zero, thereby making it unable to deflect any droplets 12 having a non zero charge $q \neq 0$: they are subjected to a net force expressed by $F = q \cdot E_{average} = 0$ (see FIG. 2). For example, the oscillation frequency of the potential HT will be higher than 10 kHz for V=10 m/s and an electrode 8 length of 1 mm.

Advantageously, two consecutive jet segments 10 intended for printing are separated by a jet portion 2' of which the length is at least equal to the distance separating the downstream end, in the direction of the path A, of the shield electrode 14 and the downstream end of the deflecting electrode 8, so as to direct this portion 2' appropriately toward the gutter 6. The interval separating two pairs of pulses is consequently adapted, in particular to form residual jets longer than the length of the electrode 8, that is, typically longer than 1 mm.

To ensure the efficiency of the printing principle, it is preferable not to break up the jet 2 face to the high voltage electrode 8 which deflects the jet: this situation would lead to the formation of droplets (not shown) with paths differing from the two hydraulic A and deflected B reference paths. These misdirected droplets would be capable of polluting the print head.

However, it is possible to break up the jet 2 (or the jet portion 2') downstream of the deflecting electrode 8. Any droplets produced would then follow the path B of the deflected jet, given that the jet is not subjected to an external force. This option makes it possible, in particular, to limit ink splashing when it is collected in the gutter 6. Among the many possible solutions, a piezoelectric actuator for this purpose can, for example, be attached to the drop generator 1: a low-level electrical signal, applied to the actuator, produces a mechanical vibration in the entire drop generator; the jet array is thus only slightly stimulated, and the jets are fragmented into calibrated drops at a given distance from the nozzle plate and at the rate imposed by the electrical signal.

Figure 2:
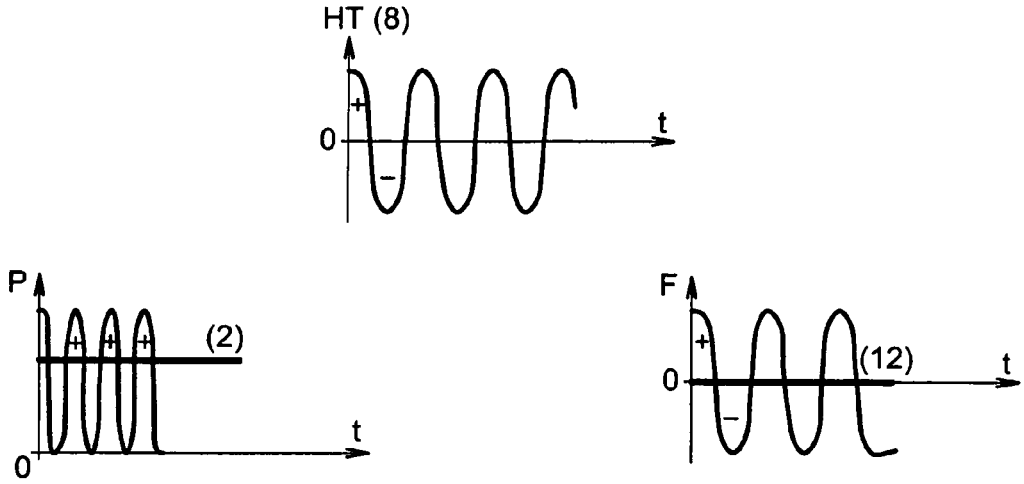
FIG. 2 shows the effects, on a jet or a drop, of the application of a sinusoidal high voltage HT on the deflection electrode.
Figure 3:
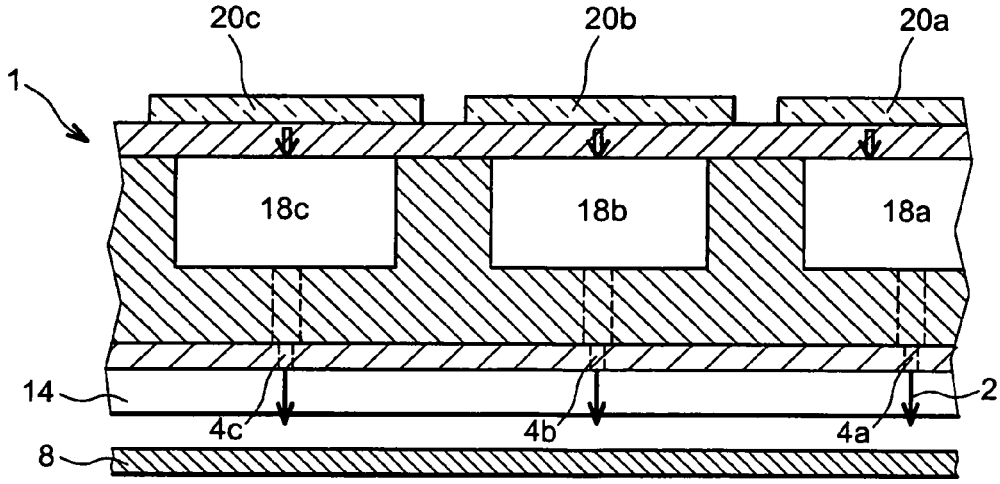
FIG. 3 shows a sectional view of a drop generator according to the invention being part of a printing head according to a preferred embodiment.

The method according to the invention is preferably implemented in a multijet print head, and in particular with a drop generator 1 as shown in FIG. 2. A chamber feeds the ink to an array of nozzles 4*a*, 4*b*, 4*c*, for example 100 jets with a diameter of 35 μm located in a single plane spaced apart by 250 μm, by an individual hydraulic path. Each path includes, in particular, a stimulation chamber 18*a*, 18*b*, 18*c*, one of the surfaces of which, for example a single membrane, is deformed by a piezoelectric actuator 20*a*, 20*b*, 20*c*. The volume of ink contained in the chamber 18*i* varies according to the action of the piezoelectric element 20*i*, which itself is controlled by an electric voltage, and in particular a stimulation signal as shown in FIG. 1B; the amplitude of the command signal can be of the order of some thirty volts, and thus does not cause overheating which would be detrimental for the ink.

The shield electrode 14 is preferably in the form of a plate having a thickness greater than 1+d which is fixed directly on the nozzle plate 4, on an outlet side, and is common to all of the nozzles 4*i*. The device also preferably includes a single deflecting electrode 8, in the form of a longitudinal plate parallel to the shield electrode 14 and separated by a set distance.

The device according to the invention thus makes it possible to produce drops coming from a continuous jet and capable of being printed. Compared with the existing techniques, this principle of printing by jet deflection provides the following advantages:

- Outside of printing situations, the operation of the device is almost static: the functions of stimulation and collection of jets are separated. A stimulation failure does not prevent the ink jets from being properly collected; moreover, since the jet stimulation device is not constantly fed by an electrical signal, it has a longer lifetime and improved reliability.
- The formation of a segment 10 is an asynchronous process, which provides the possibility of activating the formation of segments as desired, i.e. based on print quality requirements and no longer on requirements for synchronisation with respect to stimulation and/or the charging process. The benefit is particularly notable in multijets with the possibility of compensating for differences in speed and impact diameter between the jets by adjusting the time of application of pulses creating the drop.
- The kinetics for charging the jet portion 2 opposite the deflecting electrode 8 are associated with the forward speed V of the jet 2 and not with the rate 1/T of formation of the drops 12. The order of magnitude of the charging time is typically of the order of a millisecond and not a microsecond. In fact, the printing principle according to the invention accepts liquids with an electrical conductivity that is clearly lower than that of the liquids normally projected by continuous ink jet printers.
- The length l of the jet segment 10 can be adjusted as desired, the jet segment 10 being however always initiated and ended at the same point. This provides the possibility of continuously varying the impact diameter and thus makes it possible to print an image with different grey levels or to maintain the impact diameter on different types of substrates 16.
- The functional elements (shield 14, deflecting electrode 8, gutter 6) are located on the same side of the jets 2 with respect to the direction defined by the nozzles 4, and the print head is accessible for performing maintenance operations.
- The production of undesirable satellite droplets is less problematic, because the satellites are only very slightly deflected, as they are only slightly exposed to the electrostatic pressure force which causes the deflection of the jet. The path of the satellites is aligned with that of the printed segments without polluting the print head.

The invention claimed is:

1. Method for selectively deflecting portions of a continuous jet, wherein the method includes:

- the formation of a continuous jet of conductive liquid discharged at a predetermined speed by a nozzle of a pressurized chamber along a hydraulic path;
- the perturbation of the jet in order to produce segments having first lengths by breaking up the jet at a single jet break up point which is at a predetermined distance from the discharge nozzle;
- the generation of an electric field downstream of the jet break up point along the hydraulic path;
- the differential deflection of the continuous jet and the segment by the electric field,
- wherein the perturbation of the jet in order to produce segments is in the form of groups of two successive pulses on a stimulation device located at the level of the liquid chamber.

2. Method according to claim 1, wherein the generation of the electric field is performed by subjecting a deflecting electrode to a high potential.

3. Method according to claim 2, wherein the high potential of the deflecting electrode is static or sinusoidal.

4. Method according to claim 1 which includes the shielding of the hydraulic path at the level of the break up point, so that the electric field does not act on it and the deflection begins downstream of the shield.

5. Method according to claim 4, wherein the shielding extends downstream of the break up point over a second length greater than the first lengths, so that the segments are not deflected by the electric field.

6. Method according to claim 4 wherein the shielding is provided by bringing an electrode to the same potential as the liquid.

7. Method according to claim 1, wherein the two successive pulses are identical.

8. Method according to claim 1 wherein the two groups of successive pulses are spaced apart by a duration enabling the jet to reach the electric field.

9. Method according to claim 8 wherein the duration separating the two successive pulses of each group can be adjusted.

10. Method according to claim 1 also including the stimulation of the deflected jet downstream of the electric field so as to form second segments.

11. Method according to claim 1 wherein the perturbation of the jet is performed by means of the activation of piezoelectric means placed at the level of the chamber of liquid.

12. Method for generating an array of jets of drops comprising the simultaneous independent projection of drops by a plurality of nozzles, wherein each drop follows a hydraulic path deflected with respect to the jet from which it originates by the method according to claim 1.

13. Generation method according to claim 12, wherein the electric field and/or the shield is common to all of the jets.

14. Ink jet printing method including the generation of drops along a hydraulic path deflected with respect to the jet from which they originate by the method according to claim 1 and the collection of jet portions deflected by the electric field.

15. Device for selective deflection of conductive liquid drops comprising:

- a pressurised liquid chamber including at least one discharge nozzle for discharging the liquid in the form of a continuous jet;
- means for disturbing the jet and breaking it up at a single jet break up point which is at a constant distance from the nozzle;
- shield means extending over a first thickness along the path of the jet starting at the break point, and brought to a constant potential;
- deflection means brought to a constant potential, located downstream of the shield means and enabling the jet to be deflected from its hydraulic path downstream of the shield means,
- wherein the means for disturbing is in the form of groups of two successive pulses on a stimulation device located at the level of the liquid chamber.

16. Device according to claim 15, wherein the shield element includes an electrode brought to the same potential as the liquid.

17. Device according to claim 15 wherein the deflection means include an electrode brought to a high potential.

18. Device according to claim 15 including a plurality of nozzles enabling an array of jets to be produced, wherein a single deflection means is used for the array.

19. Device according to claim 15, wherein the means for disturbing the jet include a piezoelectric actuator at the level of each chamber.

20. Device according to claim 19, including means for generating a low-voltage pulse associated with each actuator.

21. Print head including a device according to claim 15, and means for collecting the ink of the deflected jet.

* * * * *